US012104801B2

(12) United States Patent
Sanchez Rodriguez et al.

(10) Patent No.: US 12,104,801 B2
(45) Date of Patent: Oct. 1, 2024

(54) GAS COOKING APPLIANCE

(71) Applicant: COPRECI, S.COOP., Aretxabaleta (ES)

(72) Inventors: Jose Octavio Sanchez Rodriguez, Jalisco (MX); Maider Sarriegi Galparsoro, Aretxabaleta (ES)

(73) Assignee: COPRECI, S.COOP., Aretxabaleta (ES)

( * ) Notice: Subject to any disclaimer, the term of this patent is extended or adjusted under 35 U.S.C. 154(b) by 873 days.

(21) Appl. No.: 17/191,140

(22) Filed: Mar. 3, 2021

(65) Prior Publication Data

US 2022/0186933 A1 Jun. 16, 2022

(30) Foreign Application Priority Data

Dec. 14, 2020 (EP) ..... 20383087
Jan. 28, 2021 (EP) ..... 21382065

(51) Int. Cl.
*F24C 3/12* (2006.01)

(52) U.S. Cl.
CPC ..... *F24C 3/124* (2013.01); *F24C 3/126* (2013.01)

(58) Field of Classification Search
USPC ..... 126/39 N, 39 R, 39 E
See application file for complete search history.

(56) References Cited

U.S. PATENT DOCUMENTS

| | | | | |
|---|---|---|---|---|
| 9,887,524 | B1 * | 2/2018 | Gretz | H02G 3/081 |
| 9,976,749 | B2 | 5/2018 | Yang | |
| 2010/0264344 | A1 * | 10/2010 | Shaffer | F24C 3/124 251/213 |
| 2015/0323191 | A1 * | 11/2015 | Yang | F24C 3/126 200/336 |
| 2017/0089586 | A1 | 3/2017 | Turner | |
| 2018/0017263 | A1 | 1/2018 | Roberts | |

* cited by examiner

*Primary Examiner* — Vivek K Shirsat
(74) *Attorney, Agent, or Firm* — Edell, Shapiro & Finnan, LLC

(57) ABSTRACT

According to one embodiment a gas cooking appliance is provided that includes a control panel, a valve having a valve body and an operating shaft, a control knob comprising a handle coupled to the operating shaft of the valve, and a bracket that includes a base secured to the valve body. The bracket includes and at least two arms extending from the base and being secured to the control panel. The control panel includes a housing for each arm, each housing having a shape complementary to at least one part of the end of the corresponding arm, the at least one part of each end being fitted in the respective housing.

17 Claims, 15 Drawing Sheets

GAS COOKING APPLIANCE

CROSS-REFERENCE TO RELATED APPLICATIONS

The present application relates to and claims the benefit and priority to each of European Application No. EP21382065.7, filed Jan. 28, 2021 and European Application No. EP20383087.2, filed Dec. 14, 2020.

TECHNICAL FIELD

The present invention relates to gas cooking appliances.

BACKGROUND

Gas cooking appliances comprising a bracket which allows the operating shaft of a regulating valve to be better aligned with the control panel are known. Patent documents US2017/0089586A1 and EP2942567A1, for example, describe a gas cooking appliance of this type.

EP3270063A1 describes a gas cooking appliance comprising a control panel with an opening, a regulating valve comprising a valve body and an operating shaft going through said control panel, a control knob comprising a bezel coupled to the control panel and a handle coupled to the operating shaft of the valve, and a bracket for securing the valve body to the bezel. The bezel comprises a plurality of protrusions extending from their internal face and abutting the opening of the control panel. The bracket comprises a plurality of legs mating with the protrusions of the bezel.

SUMMARY

According to one embodiment a gas cooking appliance is provided that comprises a control panel, a gas regulating valve comprising a valve body and an operating shaft going through the control panel, and a control knob comprising a handle coupled to the operating shaft of the valve.

The cooking appliance also comprises a bracket comprising a base secured to the valve body and at least two arms extending from the base, said arms of the bracket being secured to the control panel.

The control panel comprises a housing for each arm of the bracket, each housing having a shape complementary to at least one part of the end of the corresponding arm, said at least one part of the end being fitted in the respective housing.

The bracket allows the valve to be secured to the control panel, ensuring proper orientation of the valve with respect to the control panel, such that when the handle of the control knob is coupled to the operating shaft of the valve, the handle is aligned and centered in the control panel.

These and other advantages and features will become apparent in view of the figures and the detailed disclosure.

DETAILED DESCRIPTION

Figure 1:
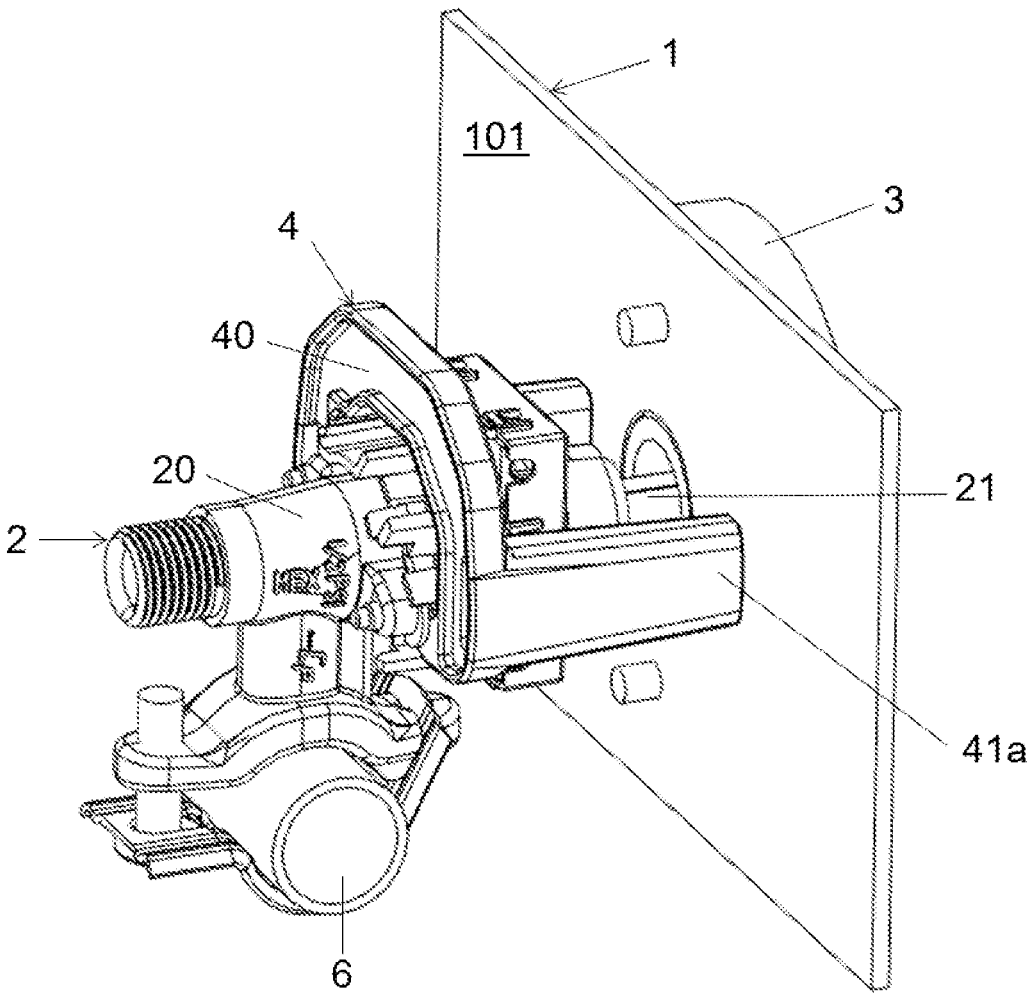
FIG. 1 shows a partial perspective view of a gas cooking appliance according to a first embodiment.
Figure 2:
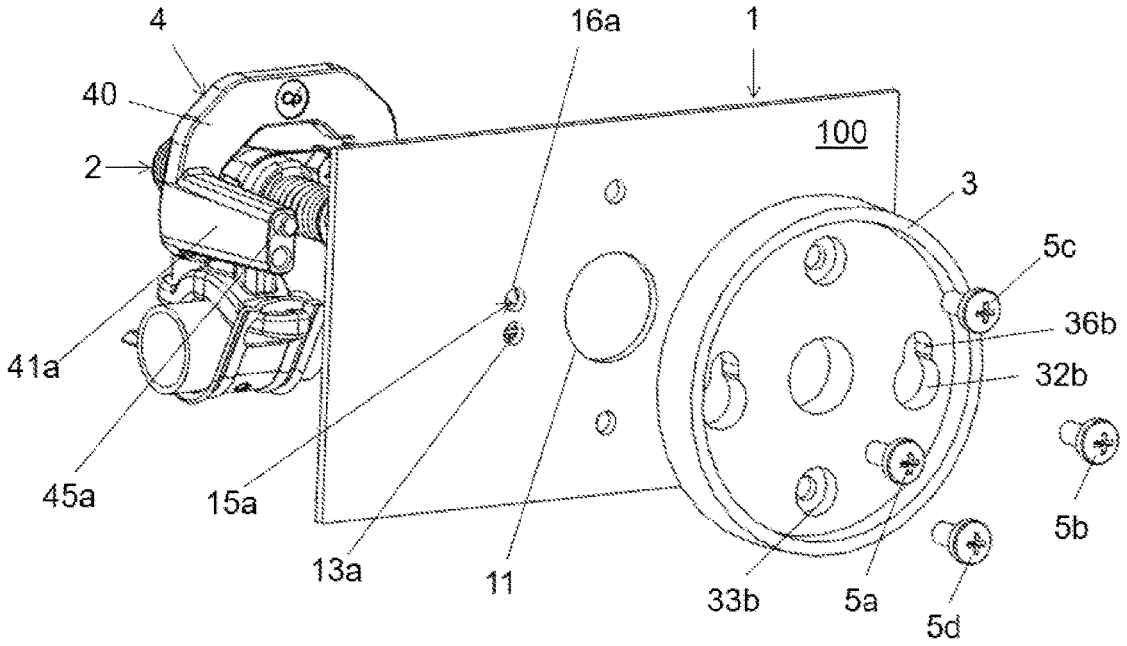
FIG. 2 shows a first exploded view of the first embodiment.
Figure 3:
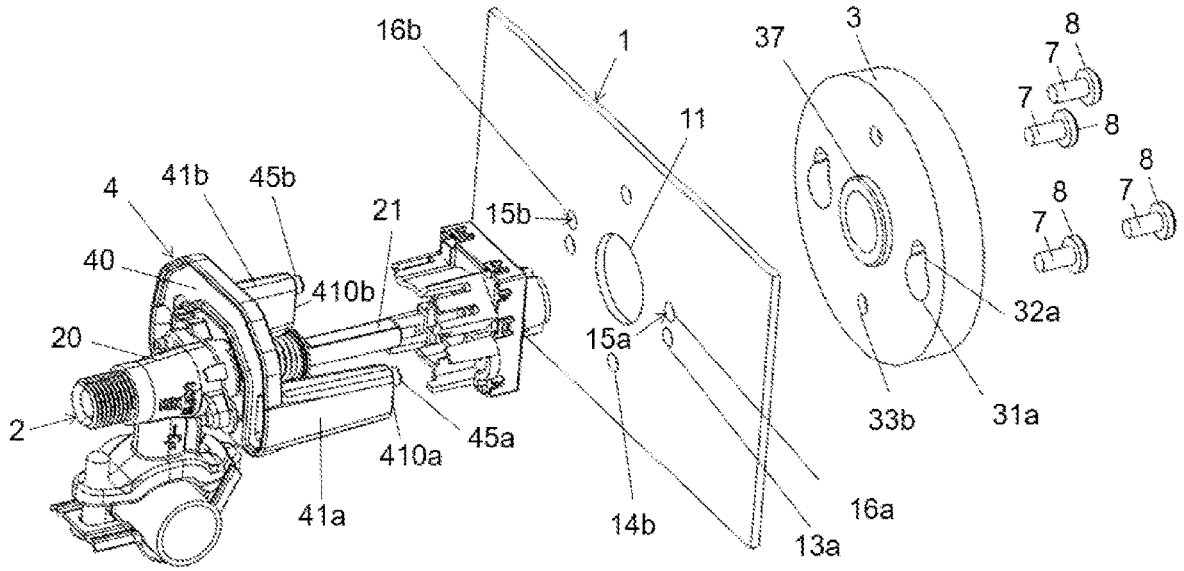
FIG. 3 shows a second exploded view of the first embodiment.
Figure 4:
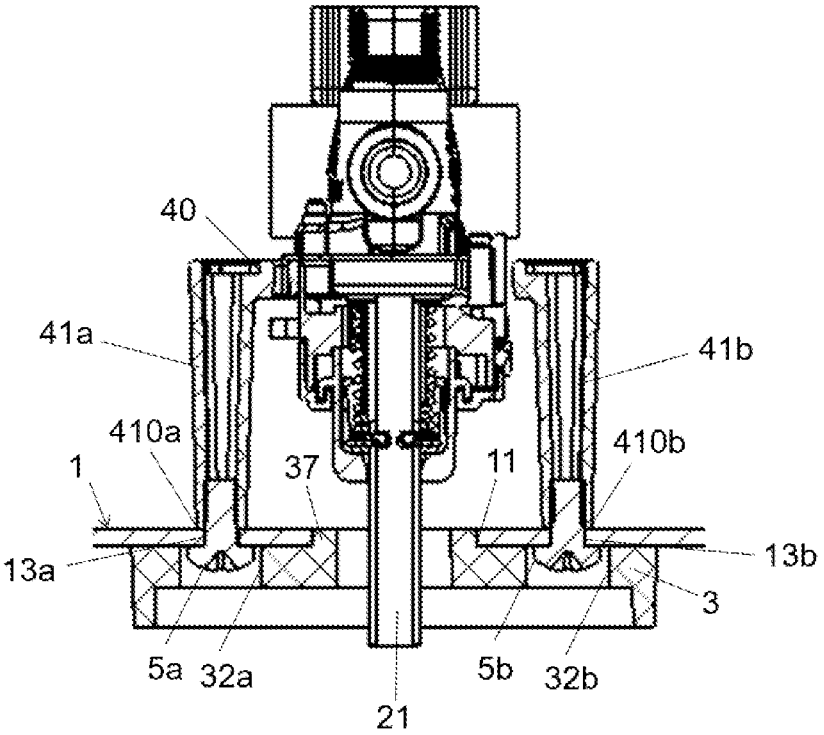
FIG. 4 shows a first section view of the first embodiment.
Figure 5:
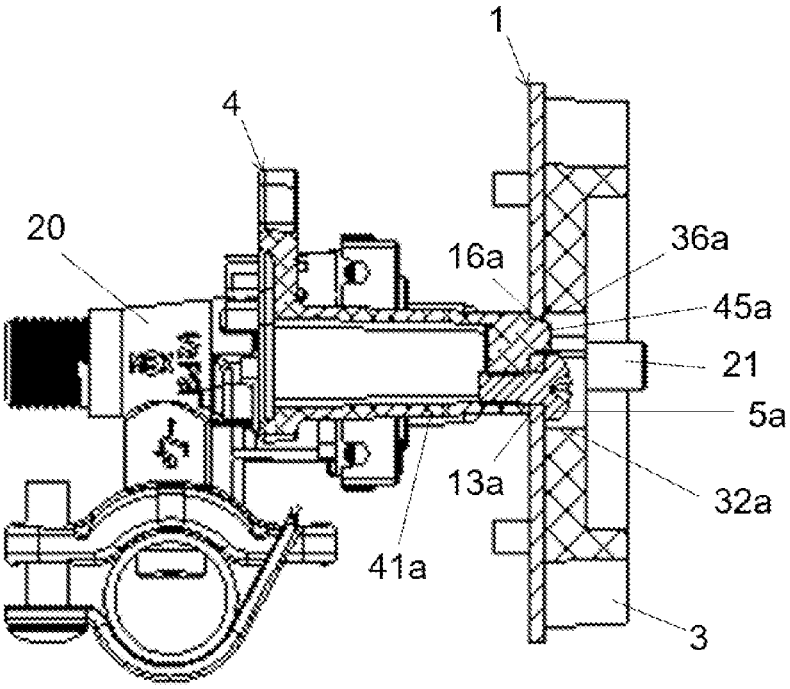
FIG. 5 shows a second section view of the first embodiment.
Figure 6:
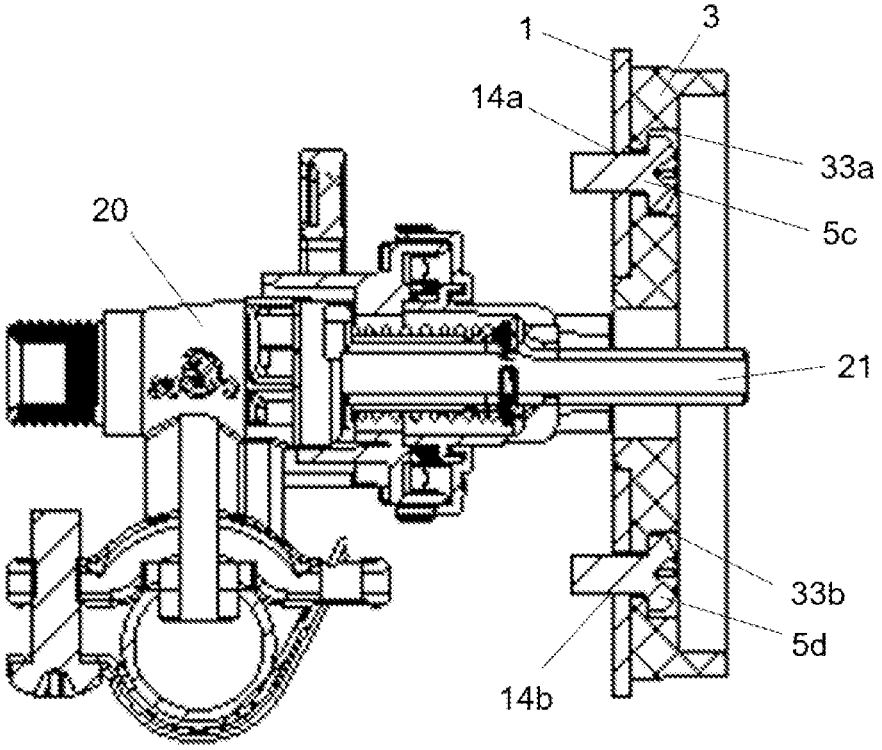
FIG. 6 shows a third section view of the first embodiment.

The gas cooking appliance comprises a control panel 1 and a gas regulating valve 2 comprising a valve body 20 and an operating shaft 21 going through the control panel 1.

The gas cooking appliance also comprises a control knob comprising a handle (not shown in the figures) coupled to the operating shaft 21 of the valve 20. Preferably the control knob assembly also comprises a bezel 3 coupled to the control panel 1.

Furthermore, the gas cooking appliance comprises a bracket 4 comprising a base 40 secured to the valve body 20 and at least two arms 41*a* and 41*b* extending from the base 40, the arms 41*a* and 41*b* of the bracket 4 being secured to the control panel 1. The arms 41*a* and 41*b* of the bracket 4 are preferably secured to the control panel 1 by means of screws 5*a* and 5*b*. Each of screws 5*a* and 5*b* comprise a threaded portion 7 and a head 8

The control panel 1 comprises one housing 15*a* and 15*b* for each arm 41*a* and 41*b* of the bracket 4, each housing 15*a* and 15*b* having a shape complementary to at least one part of the end 410*a* and 410*b* of the corresponding arm 41*a* and

41*b*, said at least one part of each end 410*a* and 410*b* being fitted in the respective housing 15*a* and 15*b*. In some embodiments, only a part of the end 410*a* and 410*b* of the respective arm 41*a* and 41*b* is fitted into the corresponding housing 15*a* and 15*b*, said part being preferably a pin 45*a* and 45*b* (as for example in the first and second embodiments described below), while in other embodiments the whole end 410*a* and 410*b* of the respective arm 41*a* and 41*b* is fitted into the corresponding housing 15*a* and 15*b* (as for example in the third, fourth and fifth embodiments described below).

Preferably the end 410*a* and 410*b* of each arm 41*a* and 41*b* of the bracket 4 comprises a pin 45*a* and 45*b*, and the control panel 1 comprises a centering hole 16*a* and 16*b* for each arm 41*a* and 41*b* of the bracket 4, each centering hole 16*a* and 16*b* demarcating the respective housing 15*a* and 15*b* having a shape complementary to the pin 45*a* and 45*b* of the end 410*a* and 410*b* of the corresponding arm 41*a* and 41*b*, each pin 45*a* and 45*b* being arranged through and fitted in the corresponding centering hole 16*a* and 16*b*. Preferably each pin 45*a* and 45*b* has a cylindrical shape, and thus each centering hole 16*a* and 16*b* is a circular hole forming a through circular housing 15*a* and 15*b*. Alternatively the control panel 1 may comprise a protrusion 12*a* and 12*b* for each arm 41*a* and 41*b* of the bracket 4, the protrusions 12*a* and 12*b* protruding from the front face 100 of the control panel 1 towards the handle, i.e. towards the outside of the cooking appliance. In this case each protrusion 12*a* and 12*b* demarcates a respective housing 15*a* and 15*b* with a shape complementary to the end 410*a* and 410*b* of the corresponding arm 41*a* and 41*b*. In other possible embodiments, the housings 15*a* and 15*b* of the control panel 1 can have different geometrical shapes provided that they demarcate a housing in which the end 410*a* and 410*b* or a part of the end 410*a* and 410*b* of the corresponding arm 41*a* and 41*b* is fitted.

In the embodiments shown in the figures, the ends 410*a* and 410*b* of the arms 41*a* and 41*b* of the bracket 4 comprise an oblong cross-section, although said cross-section may comprise any other geometric shape.

The bracket 4 allows the valve 2 to be secured to the control panel 1 ensuring proper orientation of the valve 2 with respect to the control panel 1, such that when the handle of the control knob is coupled to the operating shaft 21 of the valve 2, said handle is aligned and centered in the control panel 1.

The arms 41*a* and 41*b* of the bracket 4 are preferably only secured to the control panel 1, such that the bracket 4 and therefore the valve 2 can be kept secured to the control panel 1 should it be necessary to change any external element, such as a bezel 3 of the control knob, for example, thereby making the operator's work easier.

The control knob assembly can comprise a bezel 3 secured to the control panel 1. Preferably the bezel 3 is secured directly only to the control panel 1, and most preferably by means of screws 5*c* and 5*d* or elastic securing elements 34*a* and 34*b* extending from the inner face 30 of the bezel 3 and retained against the inner face 101 of the control panel 1. Each of screws 5*c* and 5*d* include a threaded portion 7 and a head 8.

The gas cooking appliance is preferably a gas cooktop or a gas cooker, although it could also be a gas oven or a gas barbecue grill.

The gas cooking appliance preferably comprises a casing comprising the control panel 1 in its front part. Furthermore, at least one gas burner is arranged in the casing. Inside the casing, associated with each burner, there is arranged a gas regulating valve 2 such as the one mentioned above. As discussed above, each valve 2 is operated through a respective handle arranged on the control panel 1 on the outside of the casing. The control panel 1 preferably comprises a metal plate.

The valve body 20 preferably comprises an inlet conduit 22 through which gas is supplied and configured for being coupled to a gas feed line 6, and at least one gas outlet conduit 23 and 24 which is configured for being connected by means of a gas conduit to a corresponding burner or burner holder (not shown in the figures) of the gas cooking appliance. The valve body 20 also comprises a housing in fluid communication with the inlet conduit 22 and with said at least one outlet conduit 23 and 24, a control element suitable for controlling the incoming gas flow from the inlet conduit 22 towards said at least one outlet conduit 23 and 24 depending on its angular position being housed in said housing. The control element is preferably an element having a hollow frustoconical geometry tightly arranged in the housing of the valve body 20, being capable of rotating with respect to said valve body 20. The control element may alternatively be of any other type known to one skilled in the art. The operating shaft 21 of the valve 2 comprises a first end coupled to the control element such that both parts rotate in unison. The second end of the operating shaft 21 is coupled to the handle of the control knob, as discussed above, such that both parts move in unison. The operating shaft 21 of the valve 2 rotates counterclockwise from an initial angular position in which the gas passage is closed at a final angular position, and clockwise from said final angular position to said initial angular position, such that the user may vary the gas flow rate directed towards a corresponding burner or burner holder depending on the angular position of the handle and therefore of the shaft of the operating shaft 21.

FIGS. 1 to 13 show a first embodiment of the gas cooking appliance according to the invention.

In this first embodiment, the gas cooking appliance comprises a control panel 1 and a gas regulating valve 2 comprising a valve body 20 and an operating shaft 21 going through the control panel 1.

The gas cooking appliance also comprises a control knob assembly comprising a bezel 3 coupled to the control panel 1 and a handle (not shown in the figures) coupled to the operating shaft 21 of the valve 20.

Figure 11:
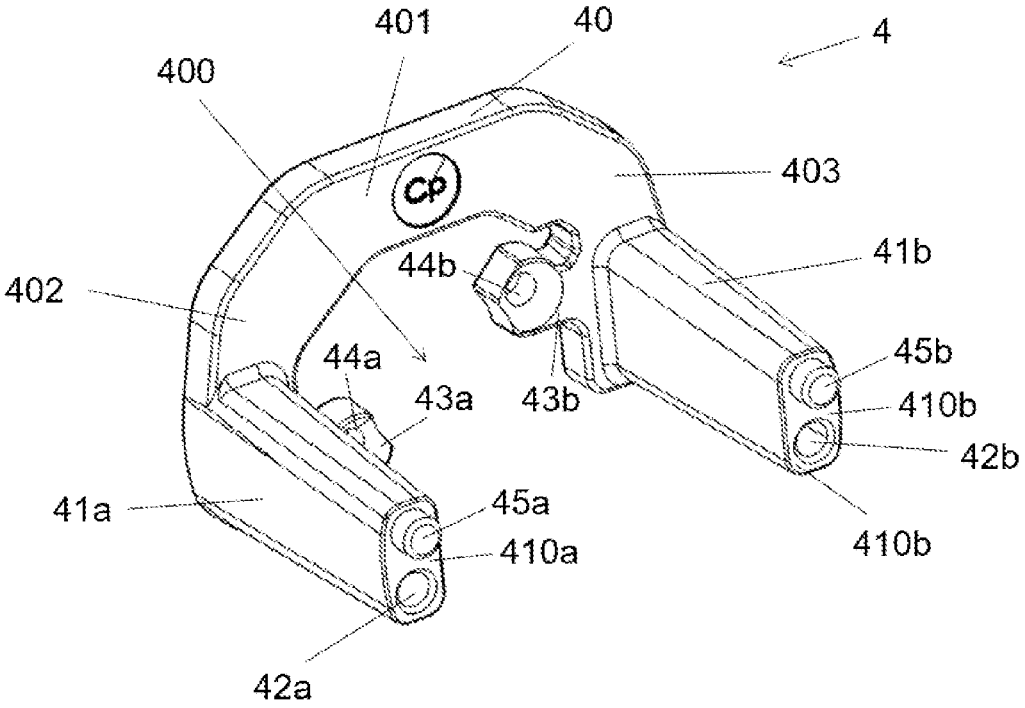
FIG. 11 shows a perspective view of the bracket of the first embodiment.

Furthermore, the gas cooking appliance also comprises a bracket 4 shown in detail in FIG. 11. The bracket 4 comprises a base 40 secured to the valve body 20 and two arms 41*a* and 41*b* extending perpendicularly from the base 40, said arms 41*a* and 41*b* being arranged facing one another. In this embodiment, the ends 410*a* and 410*b* of the arms 41*a* and 41*b* of the bracket 4 comprise a respective pin 45*a* and 45*b* which allows centering the bracket 4 with respect to the control panel 1. In this embodiment, the ends 410*a* and 410*b* of the arms 41*a* and 41*b* of the bracket 4 comprise an oblong cross-section. The front face of the end 410*a* and 410*b* of each arm 41*a* and 41*b* of the bracket 4 comprises a threaded hole 42*a* and 42*b* for securing the bracket 4 to the control panel 1. Moreover, the pins 45*a* and 45*b* which allow centering the bracket 4 with respect to the control panel 1 are extended perpendicularly from the front face of the end 410*a* and 410*b* of the corresponding arm 41*a* and 41*b*.

In this first embodiment, the base 40 of the bracket 4 is U-shaped with a central segment 401, a first side segment 402 that prolongs from a first end of said central segment 401, and a second side segment 403 that prolongs from a second end of said central segment 401, the base 40 of the bracket 4 defining a central gap 400. One of the arms 41*a* of the bracket 4 extends perpendicularly from the first side segment 402, while the other arm 41*b* extends perpendicularly from the second side segment 403. Furthermore, the base 40 comprises an extension 43*a* extending towards the central gap 400 from the first side segment 402 and an extension 43*b* extending towards said central gap 400 from the second side segment 403. The valve body 20 is secured to said extensions 43*a* and 43*b* of the base 40 by means of two screws 5*e* and 5*f*, the valve body 20 being arranged going through the central gap 400 of the bracket 4.

Figure 8:
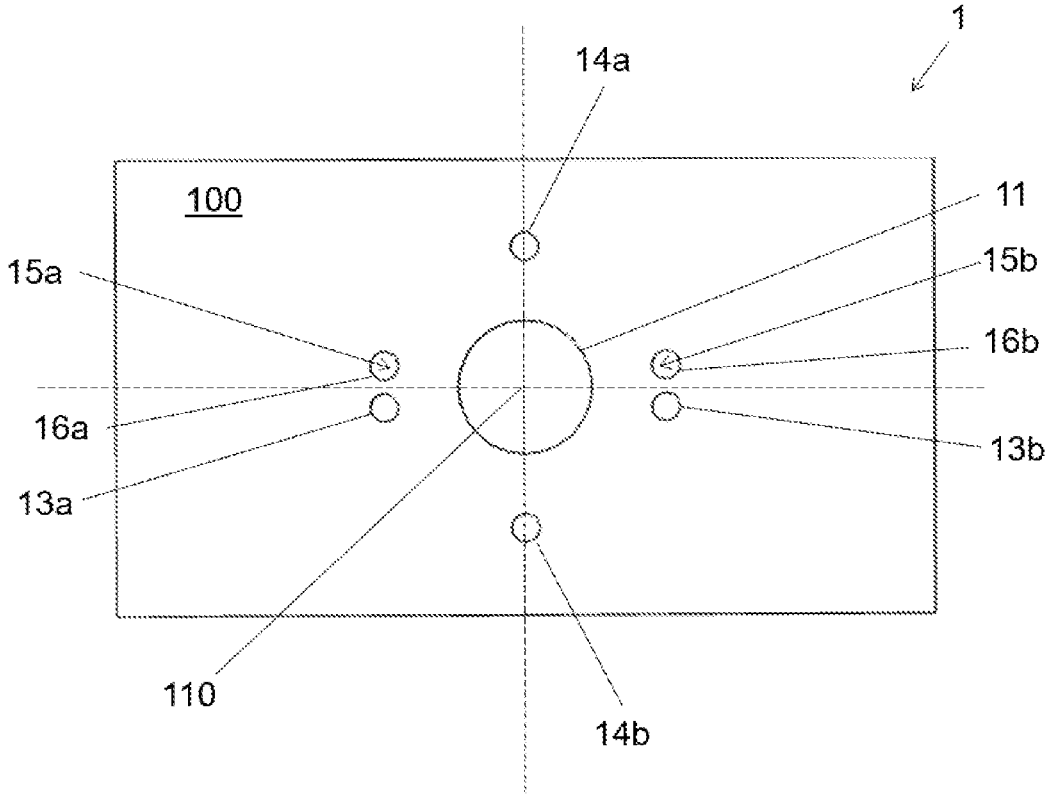
FIG. 8 shows a front view of the control panel of the first embodiment.

The control panel 1 of this first embodiment, shown in detail in FIG. 8, is preferably a metal plate. The control panel 1 comprises a centering hole 16*a* and 16*b* for each arm 41*a* and 41*b* of the bracket 4. Thus, in this first embodiment each centering hole 16*a* and 16*b* demarcates a housing 15*a* and 15*b* having a shape complementary to the pin 45*a* and 45*b* of the end 410*a* and 410*b* of the corresponding arm 41*a*, 41*b*, i.e., each centering hole 16*a* and 16*b* demarcates a circular housing 15*a* and 15*b*, each pin 45*a* and 45*b* being arranged fitted and going through the corresponding centering hole 16*a* and 16*b*, as shown in detail in FIG. 5.

The control panel 1 of this first embodiment also comprises a fixing hole 13*a* and 13*b* for each arm 41*a* and 41*b* of the bracket 4. The control panel 1 also comprises a central hole 11 through which the operating shaft 21 of the valve 2 goes. The centering holes 16*a* and 16*b* of the control panel 1 are arranged on opposite sides of the central hole 11, i.e., having the geometric center 110 (see FIG. 8) of the central hole 11 as a reference, the centering holes 16*a* and 16*b* are arranged at 180° from one another. Moreover, the fixing holes 13*a* and 13*b* of the control panel 1 are arranged on opposite sides of the central hole 11, i.e., having the geometric center 110 (see FIG. 8) of the central hole 11 as a reference, the fixing holes 13*a* and 13*b* are arranged at 180° from one another.

Figure 12:
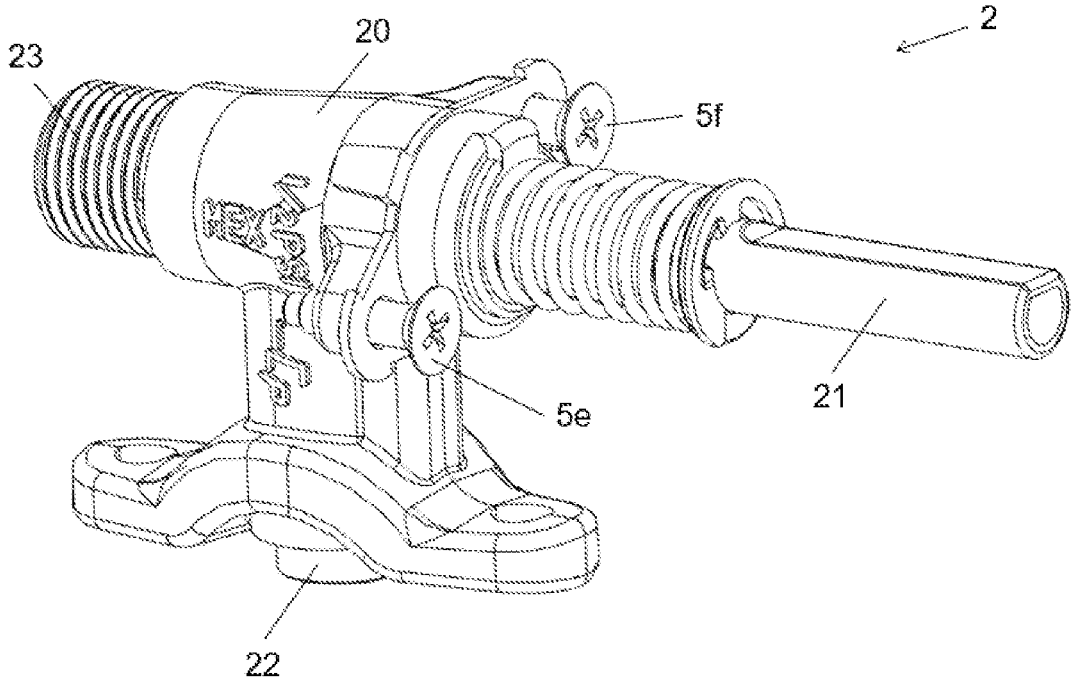
FIG. 12 shows a perspective view of the valve of the first embodiment.
Figure 13:
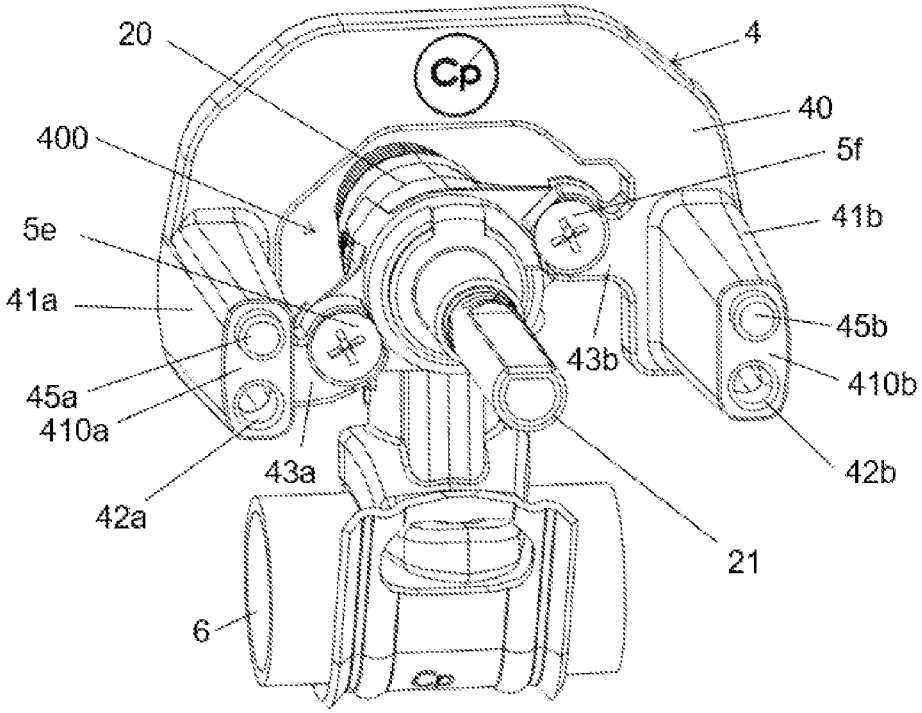
FIG. 13 shows a perspective view of the valve and the bracket of the first embodiment.

FIG. 12 shows the valve 2 of this first embodiment. In this first embodiment, the valve body 20 comprises a gas inlet conduit 22 and a gas outlet conduit 23. The valve body 20 also comprises a housing in fluid communication with the inlet conduit 22 and the outlet conduit 23, there being housed in said housing a control element suitable for controlling the incoming gas flow from the inlet conduit 22 towards the outlet conduit 23 depending on its angular position. The operating shaft 21 of the valve 2 comprises a first end coupled to the control element, the second end of the operating shaft 21 being coupled to the handle of the control knob. In other possible embodiments the valve body can comprise a plurality of outlet conduits.

Figure 9:
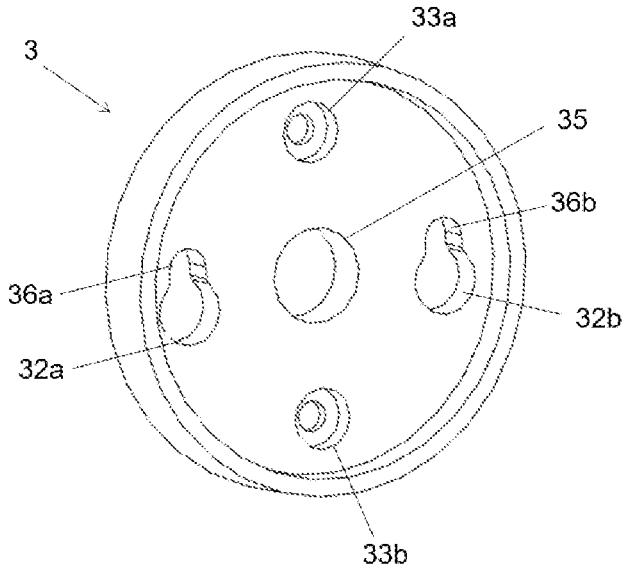
FIG. 9 shows a front view of the bezel of the first embodiment.
Figure 10:
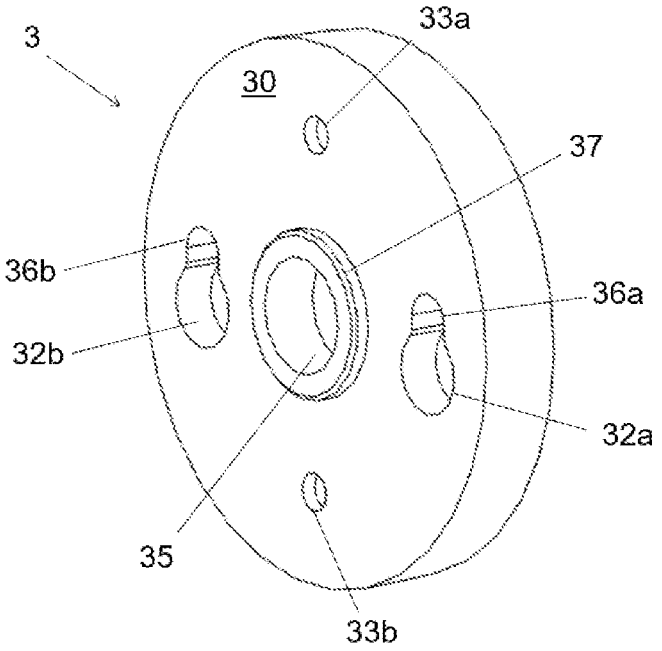
FIG. 10 shows a rear view of the bezel of the first embodiment.

FIGS. 9 and 10 show the bezel 3 of this first embodiment in detail. The bezel 3 comprises a central hole 35 which is arranged at the same level as the central hole 11 of the control panel 1, the operating shaft 21 of the valve 2 going through both central holes 11 and 35. The bezel 3 comprises on its internal face 30 around the central hole 35 a centering projection 37 which projects towards the control panel 1, said centering projection 37 being fitted in the central hole 11 of the control panel 1 so that the bezel 3 is centered with respect to the control panel 1.

Figure 7:
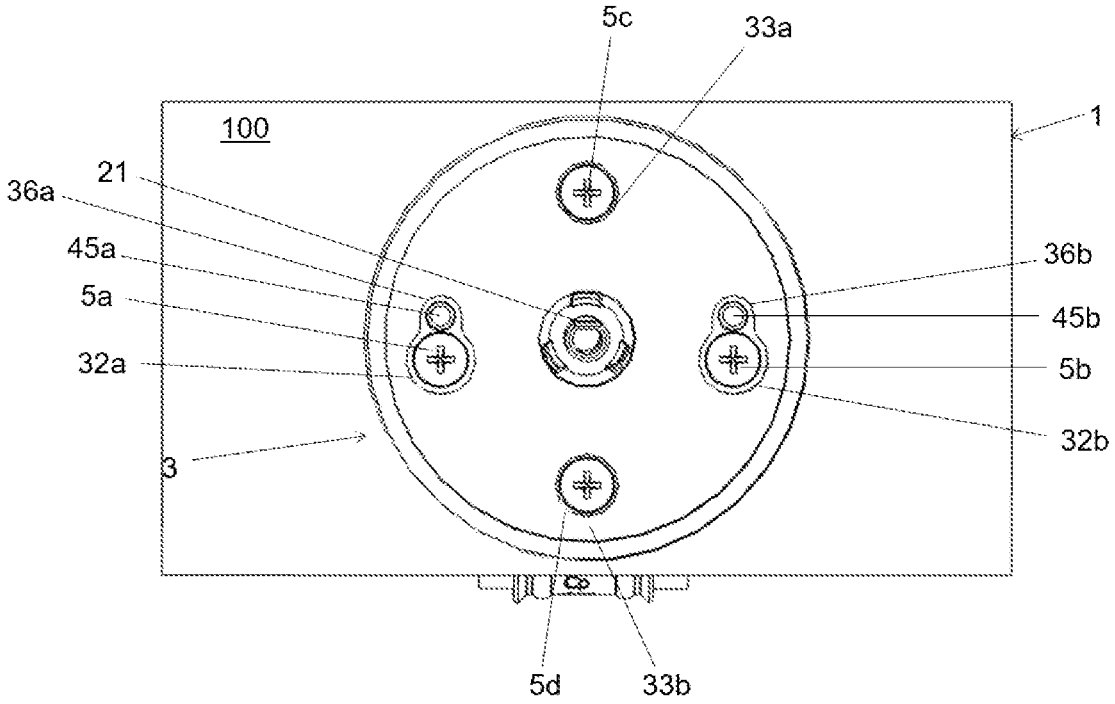
FIG. 7 shows a front view of the first embodiment.

In this first embodiment the bezel 3 comprises an opening 36*a* and 36*b* for each arm 41*a* and 41*b* of the bracket 4, said openings 36*a* and 36*b* allowing the loose-fitting passage of the respective pins 45*a* and 45*b*, as it is shown in FIG. 7.

In this first embodiment, the bracket 4 and the bezel 3 are secured to the control panel 1 independently. Therefore, should it be necessary to change the bezel 3, said bezel 3 can be released from the control panel 1 by keeping the bracket 4, and therefore the valve 2, secured to the control panel 1.

In this first embodiment the arms 41*a* and 41*b* of the bracket 4 are secured to the control panel 1 by means of screws 5*a* and 5*b*. To that end, as mentioned above, the end 410*a* and 410*b* of each arm 41*a* and 41*b* of the bracket 4 comprises a threaded hole 42*a*, 42*b* and the control panel 1 comprises a fixing hole 13*a* and 13*b* for each arm 41*a* and 41*b* of the bracket 4. Moreover, the bezel 3 comprises a passage opening 32*a* and 32*b* which allows the loose-fitting passage of a respective screw 5*a* and 5*b* for securing the arms 41*a* and 41*b* of the bracket 4 to the control panel 1.

In this first embodiment for each arm 41*a* and 41*b* of the bracket 4 the bezel 3 comprises a single opening comprising the opening 36*a* and 36*b* allowing the loose-fitting passage of the corresponding pin 45*a* and 45*b* and opening 32*a* and 32*b* allowing the loose-fitting passage of the corresponding screw 5*a* and 5*b*, as shown in FIG. 7.

In this first embodiment, the bezel 3 is also secured to the control panel 1 by means of screws 5*c* and 5*d*. To that end, the control panel 1 comprises two additional openings 14*a* and 14*b* which are arranged on opposite sides of the central hole 11, i.e., having the geometric center 110 (see FIG. 8) of the central hole 11 as a reference, the additional openings 14*a* and 14*b* are arranged at 180° from one another. In this first embodiment, the additional openings 14*a* and 14*b* are threaded holes. The bezel 3 further comprises a pair of through holes 33*a* and 33*b* at the same level as the additional openings 14*a* and 14*b* of the control panel 1.

Figure 14:
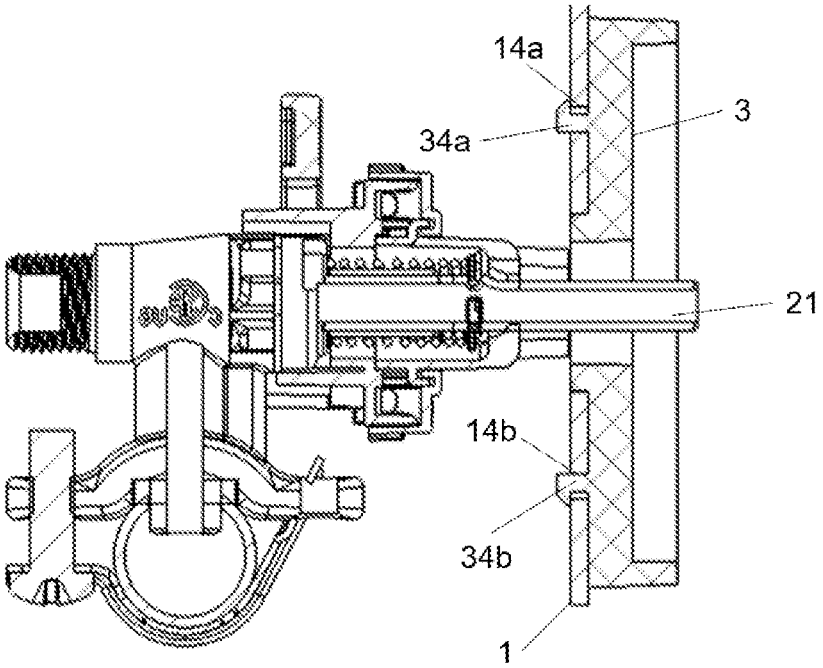
FIG. 14 shows a partial section view of a gas cooking appliance according to a second embodiment.
Figure 15:
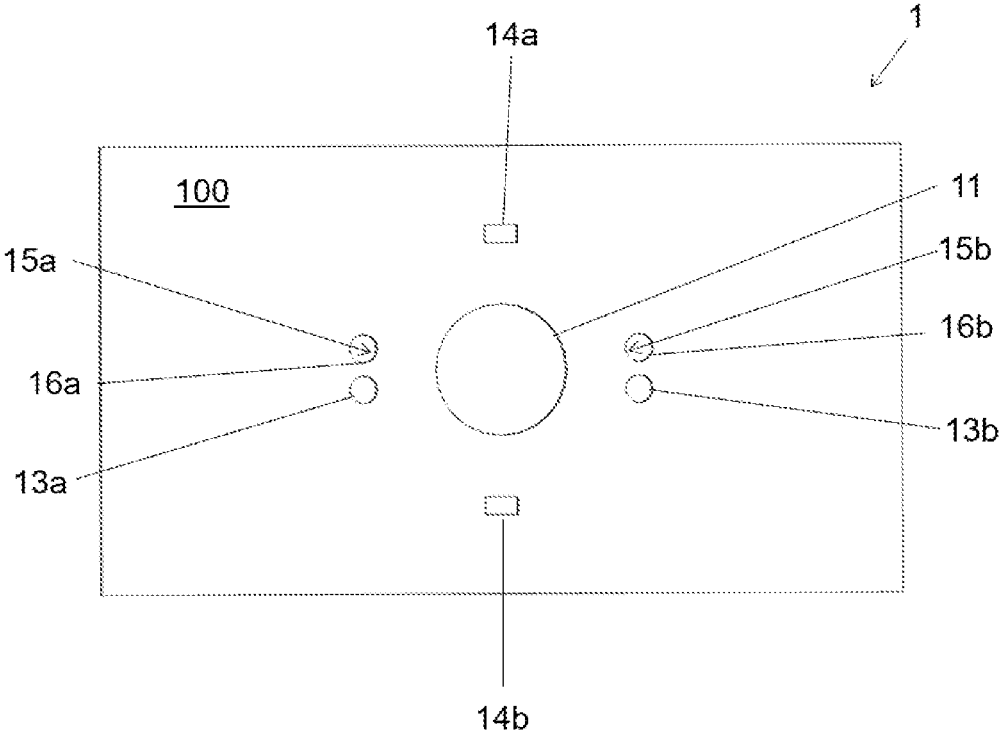
FIG. 15 shows a front view of the control panel of the second embodiment.
Figure 16:
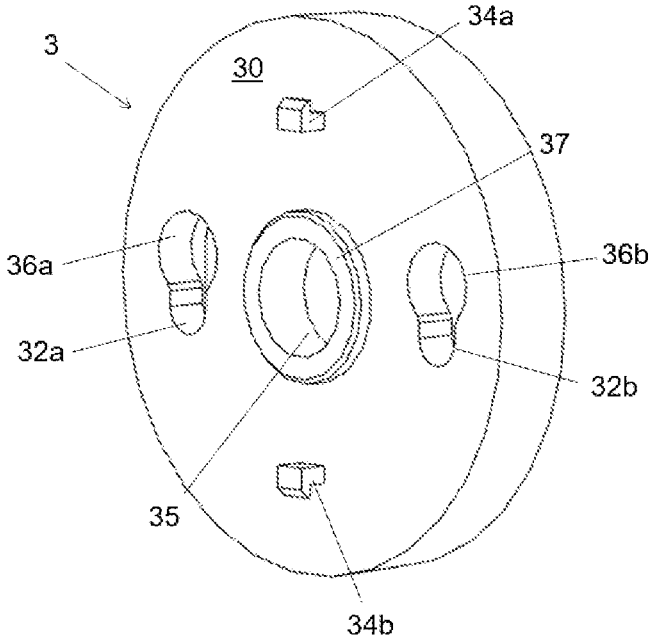
FIG. 16 shows a rear view of the bezel of the second embodiment.
Figure 17:
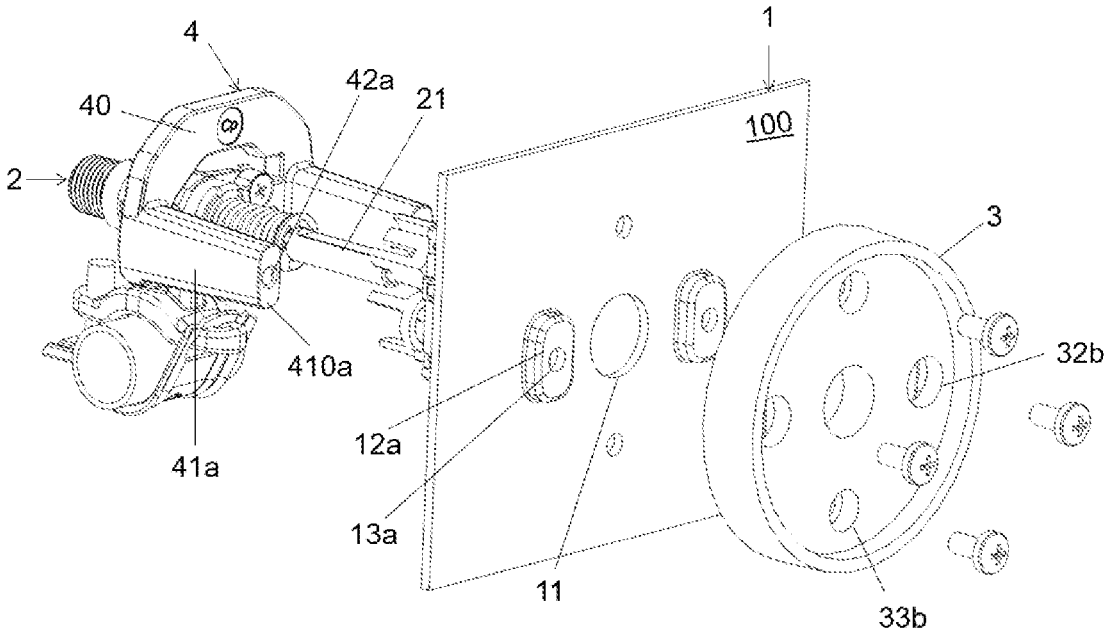
FIG. 17 shows a first exploded view of a gas cooking appliance according to a third embodiment.
Figure 18:
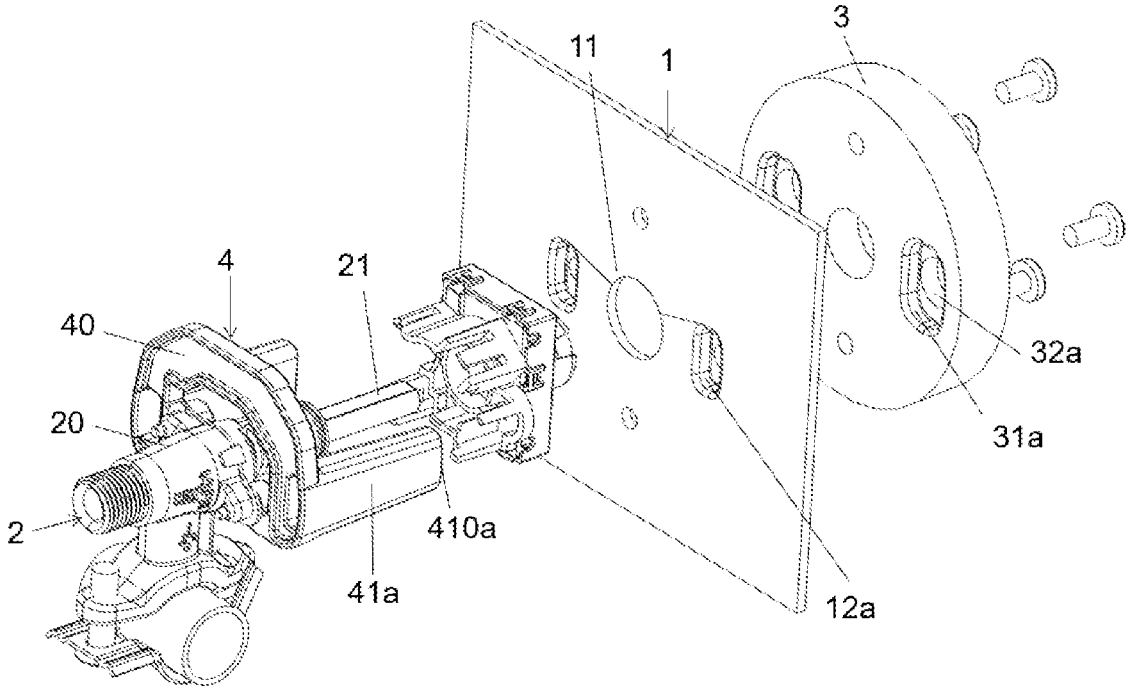
FIG. 18 shows a second exploded view of the third embodiment.
Figure 19:
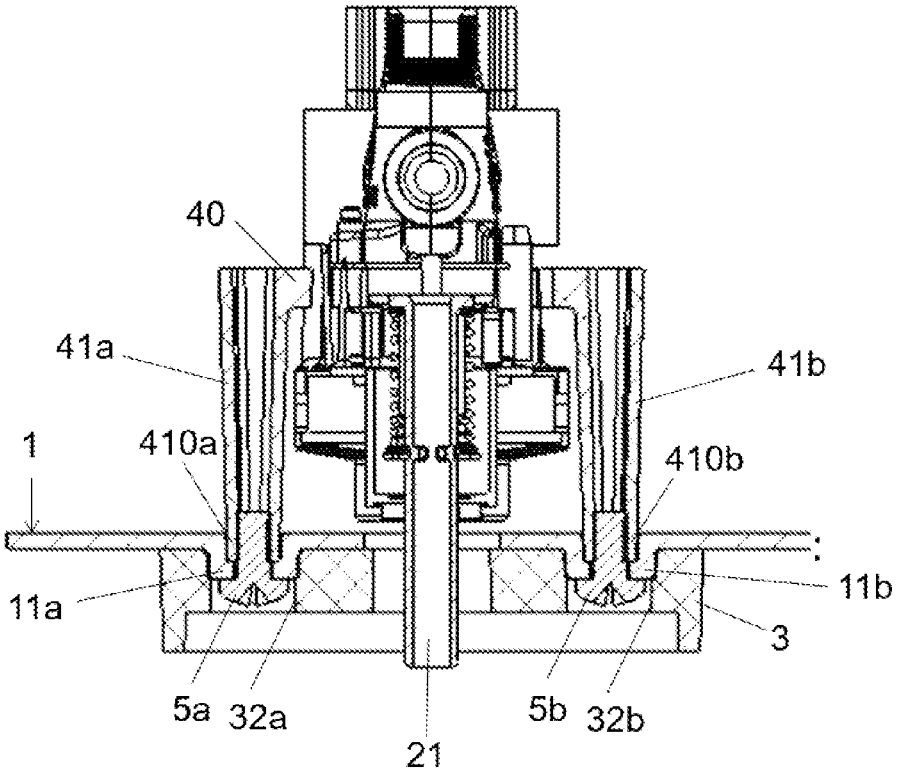
FIG. 19 shows a section view of the third embodiment.
Figure 20:
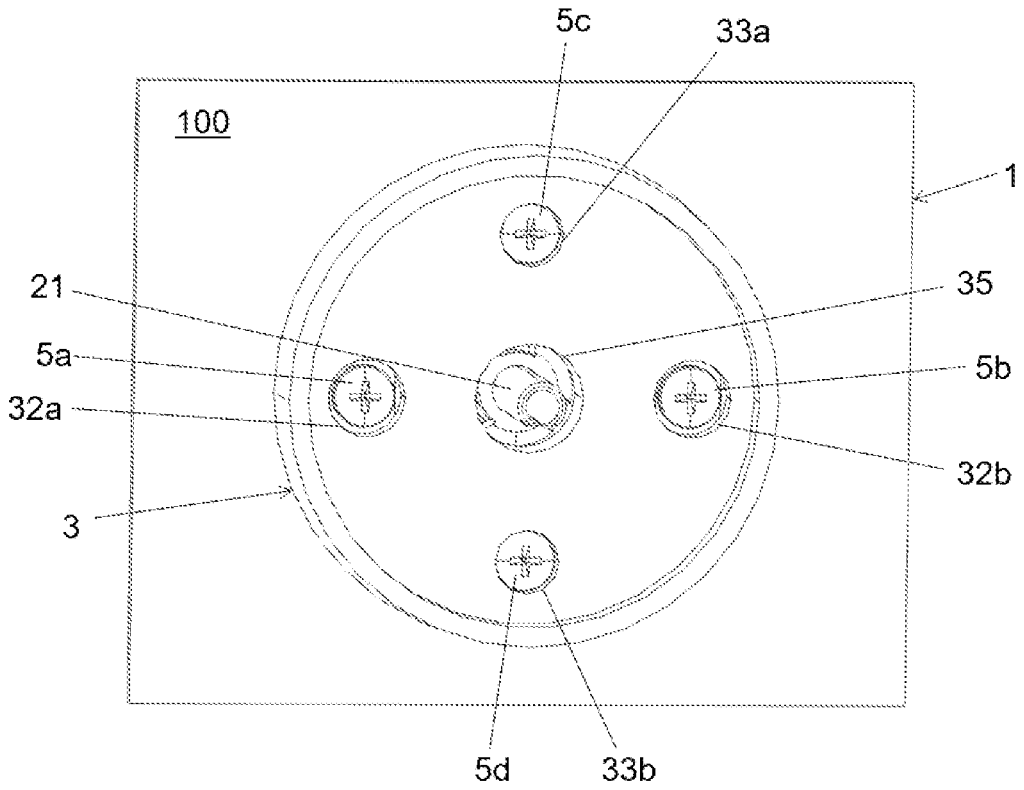
FIG. 20 shows a front view of the third embodiment.

FIGS. 14 to 16 show a second embodiment of the gas cooking appliance.

This second embodiment differs from the first embodiment in the manner of securing the bezel 3 to the control panel 1. The rest of the features are similar to those of the first embodiment, so it is not considered necessary to describe them again.

As shown in FIG. 16, in this second embodiment the bezel 3 comprises two elastic securing elements 34*a* and 34*b* that prolong from the internal face 30 of the bezel 3. Furthermore, the additional openings 14*a* and 14*b* of the control panel 1 are through openings with a shape complementary to the elastic securing elements 34*a* and 34*b*. Thus, in this second embodiment the additional openings 14*a* and 14*b* have rectangular shape. The elastic securing elements 34*a* and 34*b* of the bezel 3 go through the additional openings 14*a* and 14*b* of the control panel 1, the ends of said elastic securing elements 34*a* and 34*b* being held against the internal face 101 of the control panel 1, as shown in FIG. 14.

FIGS. 17 to 23 show a third embodiment of the gas cooking appliance.

This third embodiment differs from the first embodiment in the way the bracket 4 is centered with respect to the control panel 1, as well as in the way the bezel 3 is centered with respect to the control panel 1. The rest of the features are similar to those of the first embodiment, so it is not considered necessary to describe them again.

Figure 21:
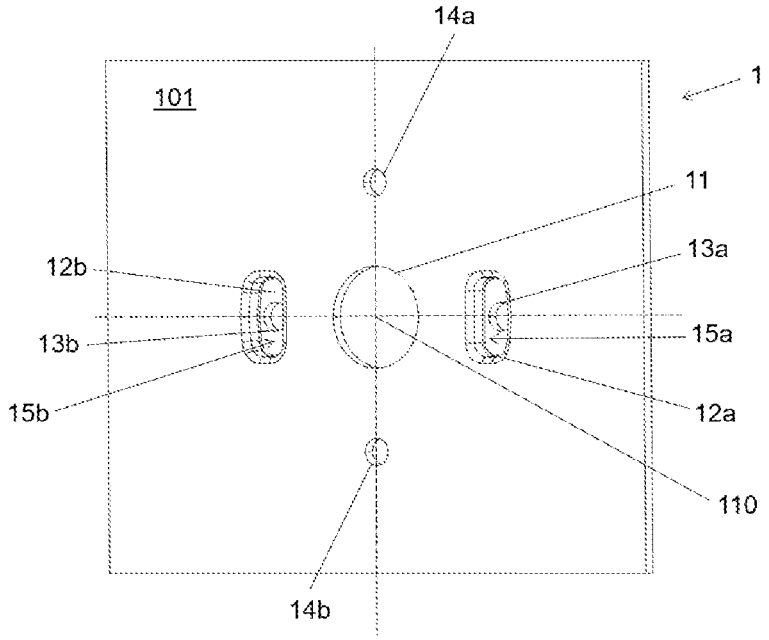
FIG. 21 shows a rear view of the control panel of the third embodiment.

The control panel 1 of this third embodiment, shown in detail in FIG. 21, is preferably a metal plate. The control panel 1 comprises one respective protrusion 12*a* and 12*b* for each leg 41*a* and 41*b* of the bracket 4, the protrusions 12*a* and 12*b* projecting from the front face 100 of the control panel 1 towards the bracket unit 3. Preferably said protrusions 12*a* and 12*b* are formed by deep drawing. Each protrusion 12*a* and 12*b* demarcates a housing with a shape complementary to the end 410*a* and 410*b* of the corresponding leg 41*a* and 41*b*, in this case a shape with an elongated cross-section, each end 410*a* and 410*b* being fitted in the housing of the respective protrusion 12*a* and 12*b*. The protrusions 12*a* and 12*b* of the control panel 1 are arranged on opposite sides of the central hole 11 of the control panel 1, i.e., having as reference the geometrical center 110 (see FIG. 21) of the central hole 11, the protrusions are arranged at 180° to each other.

Figure 22:
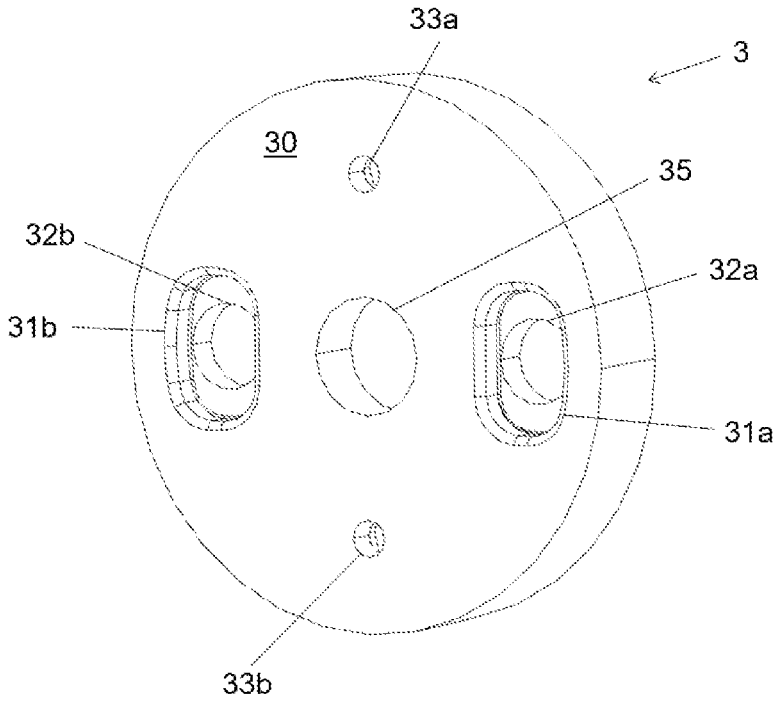
FIG. 22 shows a rear view of the bezel of the third embodiment.
Figure 23:
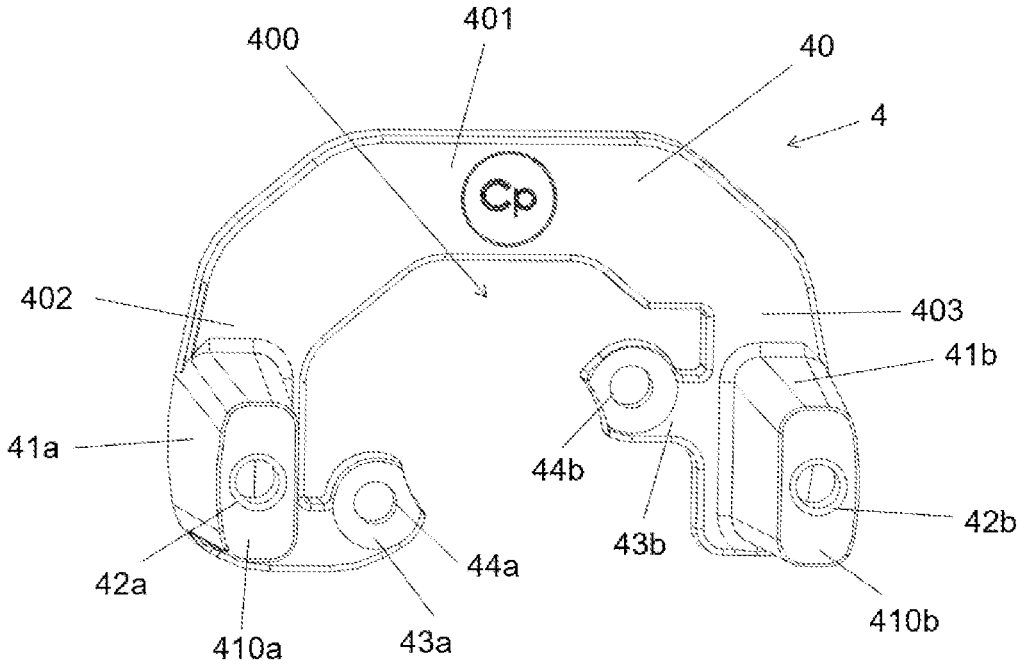
FIG. 23 shows a view of the bracket of the third embodiment.

FIG. 22 shows in detail the bezel 3 of this third embodiment. The bezel 3 comprises on its internal face 30 one cavity 31*a* and 31*b* for each protrusion 12*a* and 12*b* of the control panel 1. The cavities 31*a* and 31*b* have a shape complementary to the protrusions 12*a* and 12*b* of the control panel 1 such that said protrusions 12*a* and 12*b* fit in said cavities 31*a* and 31*b*. The cavities 31*a* and 31*b* are arranged on opposite sides of the central hole 35 of the bezel 3.

In this third embodiment, the bracket 4 and the bezel 3 are secured to the control panel 1 independently.

Thus, the arms 41*a* and 41*b* of the bracket 4 are secured to the control panel 1 by means of screws 5*a* and 5*b*. To that end, the end 410*a* and 410*b* of each arm 41*a* and 41*b* of the bracket 4 comprises a threaded hole 42*a*, 42*b*, each protrusion 12*a* and 12*b* of the control panel 1 comprises a fixing hole 13*a* and 13*b*, and each cavity 31*a* and 31*b* of the bezel 3 comprises a passage opening 32*a* and 32*b* which allows the loose-fitting passage of a respective screw 5*a* and 5*b* for securing the arms 41*a* and 41*b* of the bracket 4 to the control panel 1.

In this third embodiment, the bezel 3 is fixed to the control panel 1 by means of screws 5*c* and 5*d* as in the first embodiment.

Figure 24:
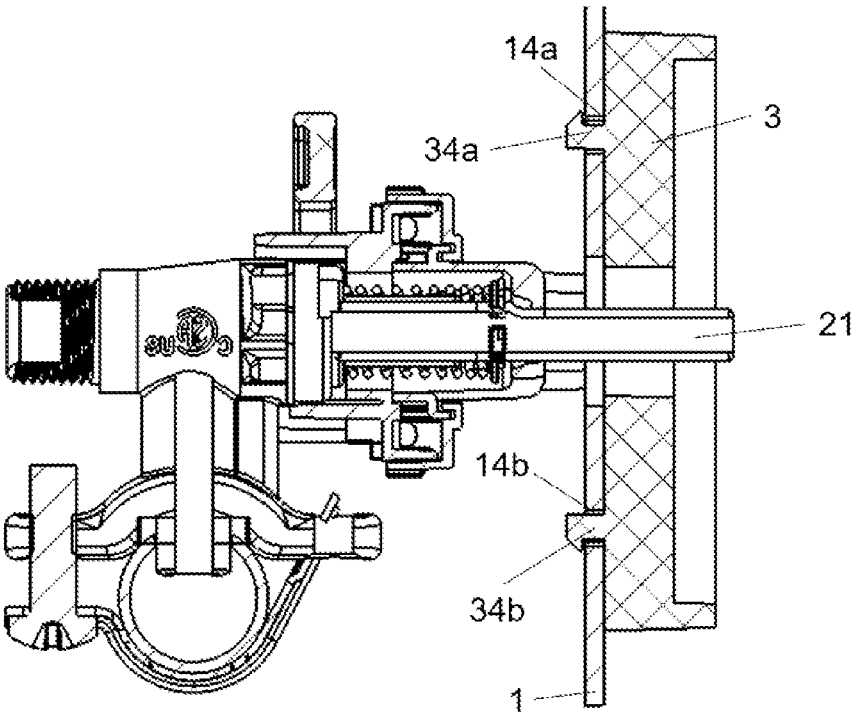
FIG. 24 shows a partial section view of a gas cooking appliance according to a fourth embodiment.
Figure 25:
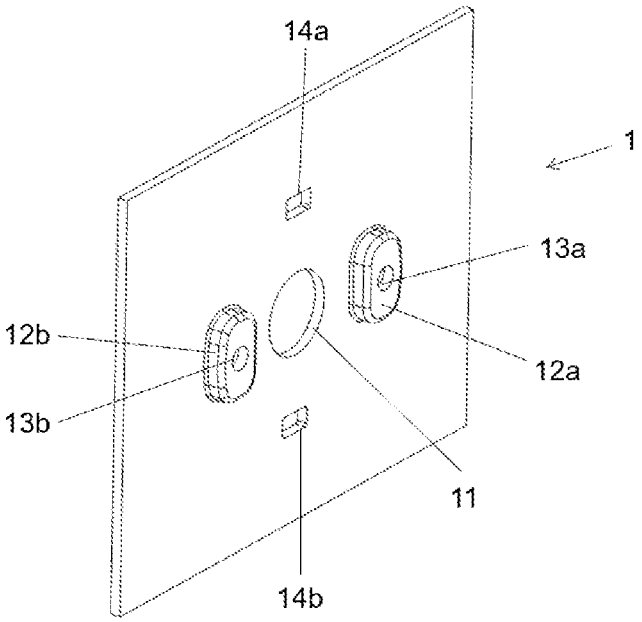
FIG. 25 shows a front view of the control panel of the fourth embodiment.
Figure 26:
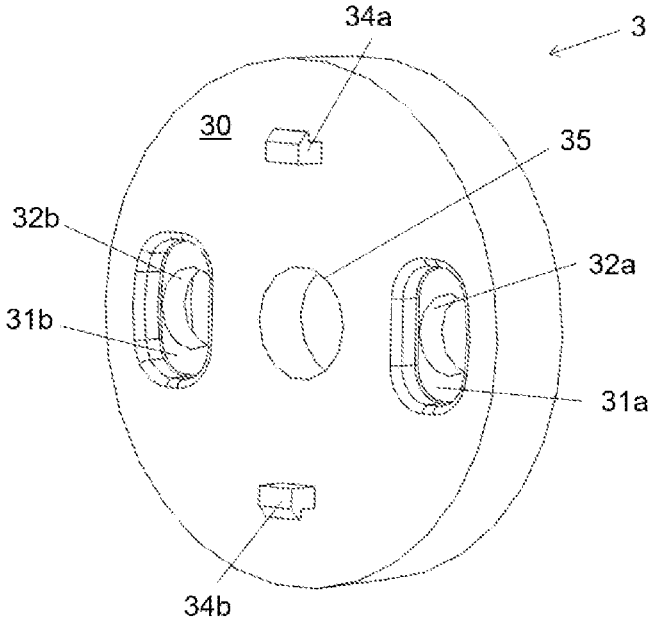
FIG. 26 shows a rear view of the bezel of the fourth embodiment.

FIGS. 24 to 26 show a fourth embodiment of the gas cooking appliance.

This fourth embodiment differs from the third embodiment in the manner of securing the bezel 3 to the control panel 1. The rest of the features are similar to those of the third embodiment, so it is not considered necessary to describe them again.

As shown in FIG. 26, in this fourth embodiment the bezel 3 comprises two elastic securing elements 34*a* and 34*b* that prolong from the internal face 30 of the bezel 3. Furthermore, the additional openings 14*a* and 14*b* of the control panel 1 are through openings with a shape complementary to the elastic securing elements 34*a* and 34*b*. Thus, in this fourth embodiment the additional openings 14*a* and 14*b* have rectangular shape. The elastic securing elements 34*a* and 34*b* of the bezel 3 go through the additional openings 14*a* and 14*b* of the control panel 1, the ends of said elastic securing elements 34*a* and 34*b* being held against the internal face 101 of the control panel 1, as shown in FIG. 24.

Figure 27:
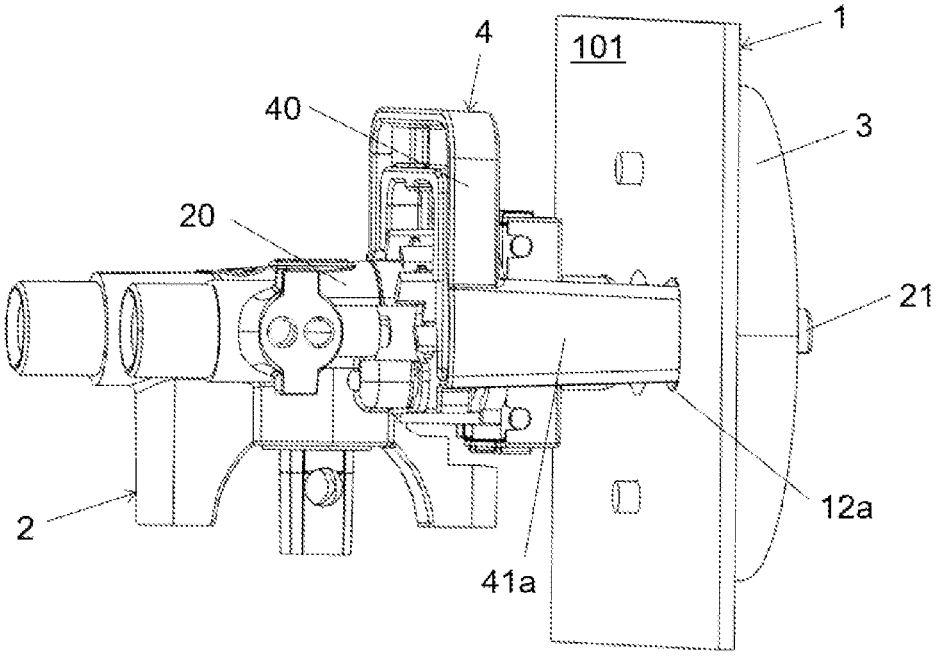
FIG. 27 shows a partial perspective view of a gas cooking appliance according to a fifth embodiment.
Figure 28:
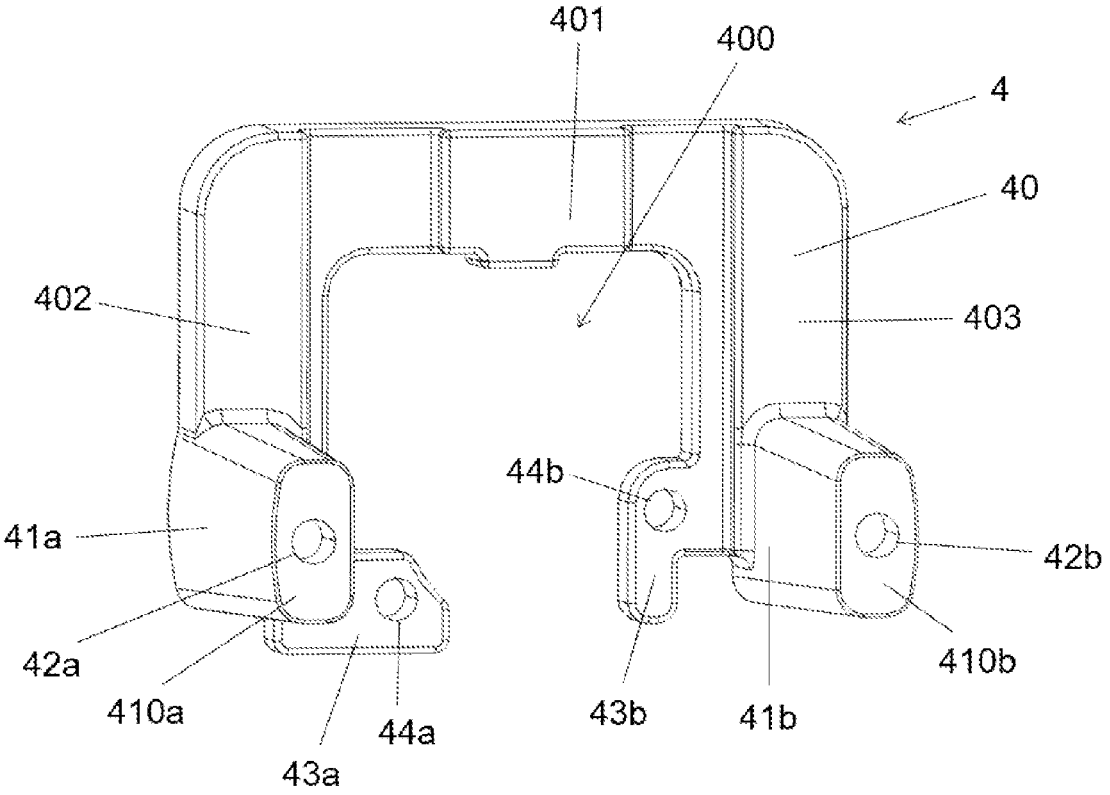
FIG. 28 shows a perspective view of the bracket of the fifth embodiment.
Figure 29:
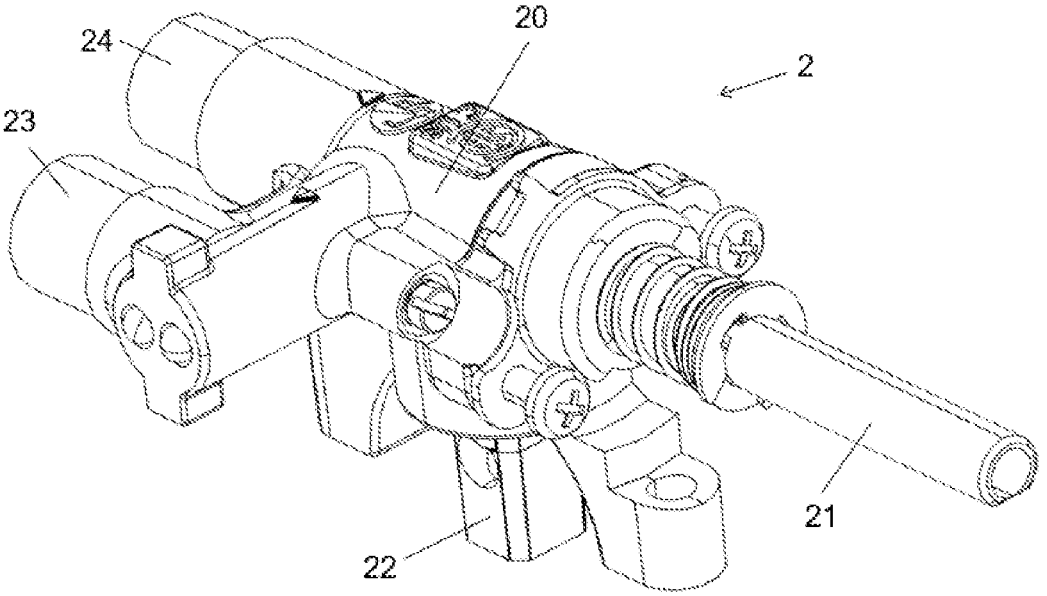
FIG. 29 shows a view of the valve of the fifth embodiment.

FIGS. 27 to 29 show a fifth embodiment of the gas cooking appliance.

This fifth embodiment differs from the third embodiment in that the valve 2 is a dual valve. Therefore, the valve body 20 comprises an inlet conduit 22 through which gas is supplied and configured for being coupled to a gas feed line 6, and two gas outlet conduits 23 and 24 which are configured for being connected by means of a gas conduit respective to a corresponding burner or burner holder (not shown in the figures) of the gas cooking appliance. The valve body 20 also comprises a housing in fluid communication with the inlet conduit 22 and the outlet conduits 23 and 24, there being housed in said housing a control element suitable for controlling the incoming gas flow from the inlet conduit 22 towards said outlet conduits 23 and 24 depending on its angular position. The control element is preferably an element having a hollow frustoconical geometry tightly arranged in the housing of the valve body 20, being capable of rotating with respect to said valve body 20. The control element may alternatively be of any other type known to one skilled in the art.

The rest of the features are similar to those of the third embodiment, so it is not considered necessary to describe them again.

The following clauses disclose additional embodiments.

Clause 1. A gas cooking appliance comprising a control panel (1), a gas regulating valve (2) comprising a valve body (20) and an operating shaft (21) going through the control panel (1), a control knob comprising a handle coupled to the operating shaft (21) of the valve (20), and a bracket (4) comprising a base (40) secured to the valve body (20) and at least two arms (41*a*, 41*b*) extending from the base (40), the arms (41*a*, 41*b*) of the bracket (4) are secured to the control panel (1), the control panel (1) comprising one housing (15*a*, 15*b*) for each arm (41*a*, 41*b*) of the bracket (4), each housing (15*a*, 15*b*) having a shape complementary to at least one part of the end (410*a*, 410*b*) of the corresponding arm (41*a*, 41*b*), said at least one part of each end (410*a*, 410*b*) being fitted in the respective housing (15*a*, 15*b*).

Clause 2. Gas cooking appliance according to clause 1, wherein the base (40) of the bracket (4) comprises two arms (41*a*, 41*b*), said arms (41*a*, 41*b*) extending perpendicularly from the base (40) and said arms (41*a*, 41*b*) being arranged facing one another.

Clause 3. Gas cooking appliance according to clause 1 or 2, wherein the ends (410*a*, 410*b*) of the arms (41*a*, 41*b*) of the bracket (4) comprise an oblong cross-section.

Clause 4. Gas cooking appliance according to any of clauses 1 to 3, wherein the bracket (4) comprises in the end (410*a*, 410*b*) of each arm (41*a*, 41*b*) a threaded hole (42*a*, 42*b*), and the control panel (1) comprises a fixing hole (13*a*, 13*b*) for each arm (41*a*, 41*b*) of the bracket (4), the control panel (1) being secured to the arms (41*a*, 41*b*) of the bracket (4) by means of screws (5*a*, 5*b*).

Clause 5. Gas cooking appliance according to any of clauses 1 to 4, wherein the end (410*a*, 410*b*) of each arm (41*a*, 41*b*) of the bracket (4) comprises a pin (45*a*, 45*b*), and the control panel (1) comprises a centering hole (16*a*, 16*b*) for each arm (41*a*, 41*b*) of the bracket (4), each centering hole (16*a*, 16*b*) demarcating the respective housing (15*a*, 15*b*) with a shape complementary to at least one part the end (410*a*, 410*b*) of the corresponding arm (41*a*, 41*b*), each pin (45*a*, 45*b*) going through the corresponding centering hole (16*a*, 16*b*).

Clause 6. Gas cooking appliance according to clause 5, wherein the control knob comprises a bezel (3) coupled to the control panel (1), the bezel (3) comprising an opening (36*a*, 36*b*) for each arm (41*a*, 41*b*) of the bracket (4), said openings (36*a*, 36*b*) allowing the loose-fitting passage of the respective pins (45*a*, 45*b*).

Clause 7. Gas cooking appliance according to clause 6, wherein the bezel (3) comprises at least a centering projection (37) which projects towards the control panel (1), said centering projection (37) being fitted in a hole of the control panel (1), said hole of the control panel (1) being preferably a central hole (11) which is also traversed by the operating shaft (21) of the valve (20).

Clause 8. Gas cooking appliance according to any of clauses 1 to 4, wherein the control panel (1) comprises one respective protrusion (12*a*, 12*b*) for each leg (41*a*, 41*b*) of the bracket (4), the protrusions (12*a*, 12*b*) projecting from the front face (100) of the control panel (1) towards the handle, and each protrusion (12*a*, 12*b*) demarcating the housing with a shape complementary to at least one part of the end (410*a*, 410*b*) of the corresponding arm (41*a*, 41*b*).

Clause 9. Cooking appliance according to clause 8, wherein the control panel (1) comprises a metal plate in which the protrusions (12*a*, 12*b*) are formed by deep drawing.

Clause 10. Gas cooking appliance according to clause 8 or 9, wherein the control knob comprises a bezel (3) fixed to the control panel (1), the bezel (3) comprising on its internal face (30) at least one cavity for housing the protrusions (12*a*, 12*b*) of the control panel (1), the bezel (3) preferably comprising on its internal face (30) one cavity (31*a*, 31*b*) for each protrusion (12*a*, 12*b*) of the control panel (1), the cavities (31*a*, 31*b*) of the internal face (30) of the bezel (3) being more preferably complementary to the protrusions (12*a*, 12*b*) of the control panel (1) such that said protrusions (12*a*, 12*b*) fit in said cavities (31*a*, 31*b*).

Clause 11. Gas cooking appliance according to any of clauses 6, 7 or 10, wherein the bracket (4) and the bezel (3) are secured to the control panel (1) independently.

Clause 12. Gas cooking appliance according to clause 11, wherein the bezel (3) comprises one passage opening (32*a*, 32*b*) for each arm (41*a*, 41*b*) of the bracket (4), each passage opening (32*a*, 32*b*) of the bezel (3) allowing the loose-fitting passage of a screw (5) for securing the arms (41*a*, 41*b*) of the bracket (4) to the control panel (1).

Clause 13. Gas cooking appliance according to clause 11 or 12, wherein the control panel (1) comprises two additional openings (14*a*, 14*b*) that are traversed by securing means that fix the support unit (3) to the control panel (1).

Clause 14. Gas cooking appliance according to clause 13, wherein the bezel (3) comprises a pair of through holes (33*a*, 33*b*) at the same level as the additional openings (14*a*, 14*b*) of the control panel (1), said additional openings (14*a*, 14*b*) being threaded holes, and the securing means being screws (5).

Clause 15. Gas cooking appliance according to clause 13, wherein the securing means comprise at least two elastic securing elements (34*a*, 34*b*) that prolong from the internal face (30) of the bezel (3) and go through the additional openings (14*a*, 14*b*) of the control panel (1), the ends of said elastic securing elements (34*a*, 34*b*) being held against the internal face (101) of the control panel (1).

What is claimed is:

1. A gas cooking appliance having a control panel and comprising:

a gas regulating valve comprising a valve body and an operating shaft that passes through an opening in the control panel;

a control knob comprising a handle coupled to the operating shaft;

a bracket including a base and first and second arms extending from the base, the base being secured to the valve body, the first and second arms respectively including first and second ends; and a control panel to which the first and second arms are attached, the control panel having a backside facing the bracket in which are located first and second housings that each has a shape that is complementary to at least a part of the respective first and second ends of the first and second arms of the bracket, the at least part of the first and second ends being fitted in the respective first and second housings;

the bracket including first and second threaded holes respectively located in the first and second ends of the first and second arms, the control panel including first and second fixing holes that extend through the control panel, the control panel being secured to the first and second arms by first and second screws, a threaded portion of each of the first and second screws being respectively threaded into the first and second threaded holes of the first and second arms, the first and second screws respectively including first and second heads that press against a front side of the control panel, a portion of each of the first and second screws respectively passing through the first and second fixing holes;

the control knob being a part of a control knob assembly, the control knob assembly including a bezel fixed to the control panel, the bezel having a front side and a backside, the backside of the bezel facing the front side of the control panel, the bezel having first and second through openings that are respectively arranged in axial alignment with first and second threaded holes of the control panel, the bezel being fixed to the control panel by third and fourth screws, a threaded portion of each of the third and fourth screws being respectively threaded into the first and second threaded holes of the control panel, the third and fourth screws respectively including third and fourth heads that press against the front side of the bezel, a portion of each of the third and fourth screws respectively passing through the first and second through openings of the bezel;

the bezel including first and second passage openings that are respectively axially aligned with the first and second threaded holes of the first and second arms of the bracket, at least a portion of each of the first and second screws being respectively located in the first and second passage openings of the bezel.

2. The gas cooking appliance according to claim 1, wherein no portion of the first and second screws make contact with the bezel.

3. The gas cooking appliance according to claim 1, wherein the control panel includes an opening through which the operating shaft of the gas regulating valve passes, the bezel including a centering projection that resides in the opening of the control panel, the centering projection centering the bezel with respect to the opening.

4. The gas cooking appliance according to claim 1, wherein the at least part of the first end of the first arm includes a first pin and the at least part of the second end of the second arm includes a second pin, each of the first and second pins protruding in a direction towards the handle.

5. A gas cooking appliance having a control panel and comprising:

a gas regulating valve comprising a valve body and an operating shaft that passes through an opening in the control panel;

a control knob assembly comprising a bezel and a handle coupled to the operating shaft;

a bracket including a base and first and second arms extending from the base, the base being secured to the valve body, the first and second arms respectively including first and second ends; and a control panel to which the first and second arms are attached, the control panel having first and second protrusions that projecting from a front side of the control panel towards the handle, the first and second protrusions respectively defining first and second cavities that open to a backside of the control panel, the first and second ends of the first and second arms being respectively fitted inside the first and second cavities in a manner that fixes a position of the bracket with respect to the control panel.

6. The gas cooking appliance according to claim 5, wherein the bezel is fixed to the control panel, the bezel having a front side and a backside, the backside of the bezel facing the front side of the control panel, in the backside of the bezel there exists first and second cavities in which reside the first and second protrusions of the control panel, the first and second cavities of the bezel each having a shape that is respectively complementary to a shape of the first and second protrusions of the control panel such that a position of the bezel is fixed with respect to the control panel.

7. The gas cooking appliance according to claim 6, wherein the bracket and the bezel are secured to the control panel independently.

8. The gas cooking appliance according claim 6, wherein the bracket includes first and second threaded holes respectively located in the first and second ends of the first and second arms, the control panel including first and second fixing holes that extend through the control panel, the control panel being secured to the first and second arms by first and second screws with a threaded portion of each of the first and second screws respectively threaded into the first and second threaded holes of the first and second arms, the first and second screws respectively including first and second heads that press against a front side of the control panel, a portion of each of the first and second screws respectively passing through the first and second fixing holes.

9. The gas cooking appliance according to claim 8, wherein the bezel includes first and second passage openings that are respectively aligned with the first and second threaded portions of the first and second arms of the bracket, at least a portion of each of the first and second screws being respectively located in the first and second passage opening of the bezel.

10. The gas cooking appliance according to claim 9, wherein no portion of the first and second screws make contact with the bezel.

11. The gas cooking appliance according to claim 10, wherein the bezel is secured directly to the control panel by the use of third and fourth screws.

12. The gas cooking appliance according to claim 10, wherein the bezel is secured to the control panel by first and second elastic securing elements that prolong from the backside of the bezel and respectively pass through the first and second through opening of the control panel, an end of each of the first and second elastic securing elements being held against the backside of the control panel.

13. A gas cooking appliance having a control panel and comprising:

a gas regulating valve comprising a valve body and an operating shaft that passes through an opening in the control panel;

a control knob comprising a handle coupled to the operating shaft;

a bracket including a base and first and second arms extending from the base, the base being secured to the valve body, the first and second arms respectively including first and second ends; and a control panel to which the first and second arms are attached, the control panel having a backside facing the bracket in which are located first and second housings that each has a shape that is complementary to at least a part of the respective first and second ends of the first and second arms of the bracket, the at least part of the first and second ends being fitted in the respective first and second housings;

the bracket including first and second threaded holes respectively located in the first and second ends of the first and second arms, the control panel including first and second fixing holes that extend through the control panel, the control panel being secured to the first and second arms by first and second screws, a threaded portion of each of the first and second screws being respectively threaded into the first and second threaded holes of the first and second arms, the first and second screws respectively including first and second heads that press against a front side of the control panel, a portion of each of the first and second screws respectively passing through the first and second fixing holes;

the control knob is a part of a control knob assembly, the control knob assembly including a bezel fixed to the control panel, the bezel having a front side and a backside, the backside of the bezel facing the front side of the control panel, the bezel having being secured to the control panel by first and second elastic securing elements that prolong from the backside of the bezel and respectively pass through first and second through openings of the control panel, an end of each of the first and second elastic securing elements being held against the backside of the control panel.

14. The gas cooking appliance according to claim 13, wherein the at least part of the first end of the first arm includes a first pin and the at least part of the second end of the second arm includes a second pin, each of the first and second pins protruding in a direction towards the handle.

15. The gas cooking appliance according to claim 13, wherein the bezel includes first and second passage openings that are respectively axially aligned with the first and second threaded holes of the first and second arms of the bracket, at least a portion of each of the first and second screws being respectively located in the first and second passage openings of the bezel.

16. The gas cooking appliance according to claim 15, wherein no portion of the first and second screws make contact with the bezel.

17. The gas cooking appliance according to claim 13, wherein the control panel includes an opening through which the operating shaft of the gas regulating valve passes, the bezel includes a centering projection that resides in the opening of the control panel, the centering projection centering the bezel with respect to the opening.

* * * * *